US010497504B2

(12) United States Patent
Kuo et al.

(10) Patent No.: US 10,497,504 B2
(45) Date of Patent: Dec. 3, 2019

(54) UNCOUPLED MULTI-PHASE INDUCTOR

(71) Applicant: ITG ELECTRONICS, INC., New Taipei (TW)

(72) Inventors: Martin Kuo, New Taipei (TW); Nanhai Zhu, New Taipei (TW)

(73) Assignee: ITG ELECTRONICS, INC., New Taipei (TW)

( * ) Notice: Subject to any disclaimer, the term of this patent is extended or adjusted under 35 U.S.C. 154(b) by 16 days.

(21) Appl. No.: 15/840,696

(22) Filed: Dec. 13, 2017

(65) Prior Publication Data

US 2019/0180910 A1 Jun. 13, 2019

(51) Int. Cl.
*H01F 27/24* (2006.01)
*H01F 27/245* (2006.01)
*H01F 27/28* (2006.01)

(52) U.S. Cl.
CPC ..... *H01F 27/245* (2013.01); *H01F 27/2847* (2013.01)

(58) Field of Classification Search
CPC ..... H01F 27/245
USPC ..... 336/212
See application file for complete search history.

(56) References Cited

U.S. PATENT DOCUMENTS 2,825,892 A * 3/1958 Duinker ..... G11C 11/06085 365/58
7,218,199 B1 * 5/2007 Chang ..... H01F 27/2866 336/198
9,019,063 B2 * 4/2015 Ikriannikov ..... H01F 3/10 336/212
2006/0145800 A1 * 7/2006 Dadafshar ..... H01F 27/2847 336/82
2008/0309299 A1 * 12/2008 Wei ..... H02M 3/156 323/247
2009/0108971 A1 * 4/2009 Okamoto ..... H01F 27/266 336/65
2009/0144967 A1 * 6/2009 Hasu ..... H01F 27/2847 29/605
2010/0321145 A1 * 12/2010 Kaoru ..... H01F 27/2847 336/222
2017/0178784 A1 * 6/2017 Janis ..... H01F 27/24
2017/0178794 A1 * 6/2017 Yan ..... H01F 27/263
2017/0287615 A1 * 10/2017 Lu ..... H01F 1/34

* cited by examiner

*Primary Examiner* — Ronald Hinson
(74) *Attorney, Agent, or Firm* — Intellectual Property Law Group LLP

(57) ABSTRACT

The disclosure is related to an uncoupled multi-phase inductor that includes a primary iron core, multiple secondary iron cores, multiple metal strip coils and multiple sheet members. The primary iron core includes multiple grooves, in which multiple middle cylinders are correspondingly installed. The middle cylinders in the primary iron core, the secondary iron cores in the grooves, and the metal strip coils are assembled. The sheet members are also integrated in the assembly for forming one single device with two or more inductors. For reaching a requisite inductance, the inductors administrate air gaps among the primary iron core and the secondary iron cores by the sheet members. The multi-phase inductor shares the middle cylinder with the primary iron core as one device so as to increase power density since the space can be saved. The device integrated with the two or more inductors has an extreme low coupling coefficient.

10 Claims, 6 Drawing Sheets

UNCOUPLED MULTI-PHASE INDUCTOR

BACKGROUND OF THE INVENTION

1. Field of the Invention

The disclosure is related to an uncoupled multi-phase inductor, and in particular to the uncoupled multi-phase inductor element with extreme low coupling coefficient, saved space, and high power density.

2. Description of Related Art

The development of the modern electronic device trends to provide high power density and high performance. A power supply product is requisite to the electronic device and pursues size reduction for gaining a high power density. Inside the power supply product, the size of inductor generally occupies more space than other components. Therefore, this causes many designers to focus on the issues of reducing the volume of the inductor inside the power supply product. However, it is not an easy goal since this engineering of optimization will cost a lot of development time.

Currently, most of the inductor components are discrete and are necessary to production of the electronic device. The discrete components need to have spacing there-between since the certain spacing and distances among the discrete components can improve the interferences being caused by the magnetic coupling effect of the inductor components. However, the spacing and the distances among the inductor components may bring negative invisible impact to the electronic device which is designed to be minimized and high performance.

Few conventional electronic devices adopt two-in-one design or multiple inductors in one device. The design with more than two inductors in the device is very rare. Even though the multiple inductors can be put together in one device by mechanically bonding, it still fails to reach the high power density due to more spaces are required. Thus this configuration is not will promoted and need to be improved.

SUMMARY OF THE INVENTION

An uncoupled multi-phase inductor disclosed in this disclosure provides a solution for the above-mentioned shortcomings. The uncoupled multi-phase inductor has the advantages such as the uncoupled multiple inductors can operate independently without interferences with each other, and the configuration can greatly reduce usage of overall volume and space. The structure of the uncoupled multi-phase inductor of the disclosure reaches an extreme low coupling coefficient among the multiple inductors, e.g. two, three, four, five, six, seven or nine inductors, through a reasonable magnetic circuit design. These inductors can be in application independently without interferences with each other.

The uncoupled multi-phase inductor achieves integrating a number of inductors into one device by introducing a middle cylinder between the groove of a primary iron core and another groove and other components. This configuration saves the volume and space required by the conventional design and increases the power density and performance of the end products.

For reaching the above-mentioned subjective, an uncoupled multi-phase inductor is provided. The uncoupled multi-phase inductor includes a primary iron core with a plurality of grooves in which a plurality of middle cylinders correspondingly formed among the grooves. The uncoupled multi-phase inductor includes a plurality of secondary iron cores that are correspondingly disposed within the grooves. The uncoupled multi-phase inductor includes a plurality of metal strip coils that are correspondingly disposed in the grooves and among the plurality of secondary iron cores. The uncoupled multi-phase inductor has a plurality of sheet members that are individually disposed among a plurality of right inner walls of the grooves, a plurality of left inner walls of the grooves and the secondary iron cores. The middle cylinder of the primary iron core, the secondary iron cores within the grooves, and the metal strip coils are assembled, and the plurality of sheet members are also integrated for forming one single device with multiple inductors. The multiple inductors administrate air gaps between the primary iron core and the secondary iron cores by the plurality of sheet members for reaching a requisite inductance.

In the uncoupled multi-phase inductor, the secondary iron core can be an I-shaped iron core, an I-sheet-shaped iron core, a T-shaped altered by the I-shaped iron core, or a near-I-shaped iron core. The primary iron core and the plurality of secondary iron cores are ferrite materials or soft magnetic materials. The plurality of metal strip coils are manufactured by a stamping process using a copper sheet or a conductive material. The sheet members are manufactured by non-Ferromagnetic materials including a mylar sheet, a kraft sheet, a plastic sheet, a glass sheet, or an assembly of different non-Ferromagnetic materials.

Inside the uncoupled multi-phase inductor, the metal strip coil is made by two vertical planes formed by two downward bending ends of the beam, and the two vertical planes form conductive leads; the conductive leads extend beyond a bottom surface of the primary iron core for standing high the uncoupled multi-phase inductor. This configuration allows the bottom of the uncoupled multi-phase inductor can be used to dispose other components or devices for saving the space of a printed circuit board. It is noted that the two vertical planes further extend downward for a through-hole welding installation.

Further, in the uncoupled multi-phase inductor, the metal strip coil is made by two vertical planes formed by two downward bending ends of the beam, and the two vertical planes stretch outward for forming conductive flat leads respectively; the bottoms of the conductive flat leads are coplanar with the bottom surface of the primary iron core for allowing the uncoupled multi-phase inductor to be combined over a plate. The plate is such as a circuit board that allows the inductor to be used in a SMD.

In the uncoupled multi-phase inductor, the multi-phase inductor is a two-phase inductor, a three-phase inductor, a five-phase inductor, a seven-phase inductor or a nine-phase inductor, and every inductor is an inductor component of a device.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The disclosure is related to an uncoupled multi-phase inductor. A reasonable magnetic circuit design is introduced to implement an extreme low coupling coefficient among multiple inductors in one device. The two or more inductors in the device can operate independently without interference with each other. Further, the design can save volume and space of the whole device.

The present invention will now be described more fully with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. For clearly explaining the invention, the size and relative size of layers and areas shown in the diagrams may be exaggerated.

It should be noted that the terms "left/left side", "right/right side", "middle", "primary", "secondary", "sheet" and the like used to describe the various components, and such terms for clearly distinguishing the elements of the embodiments should not constitute limiting terms. Therefore, the term "left/left side" as described below may indicate "right/right side" and not deviate from the original teaching of the invention. The term "and/or" include any or in combination of one or more items listed in the description. Still further, the term "plurality" or "multiple" is used to describe plural components, but not limited to any number such as two, three, four or more of the components.

Figure 1:
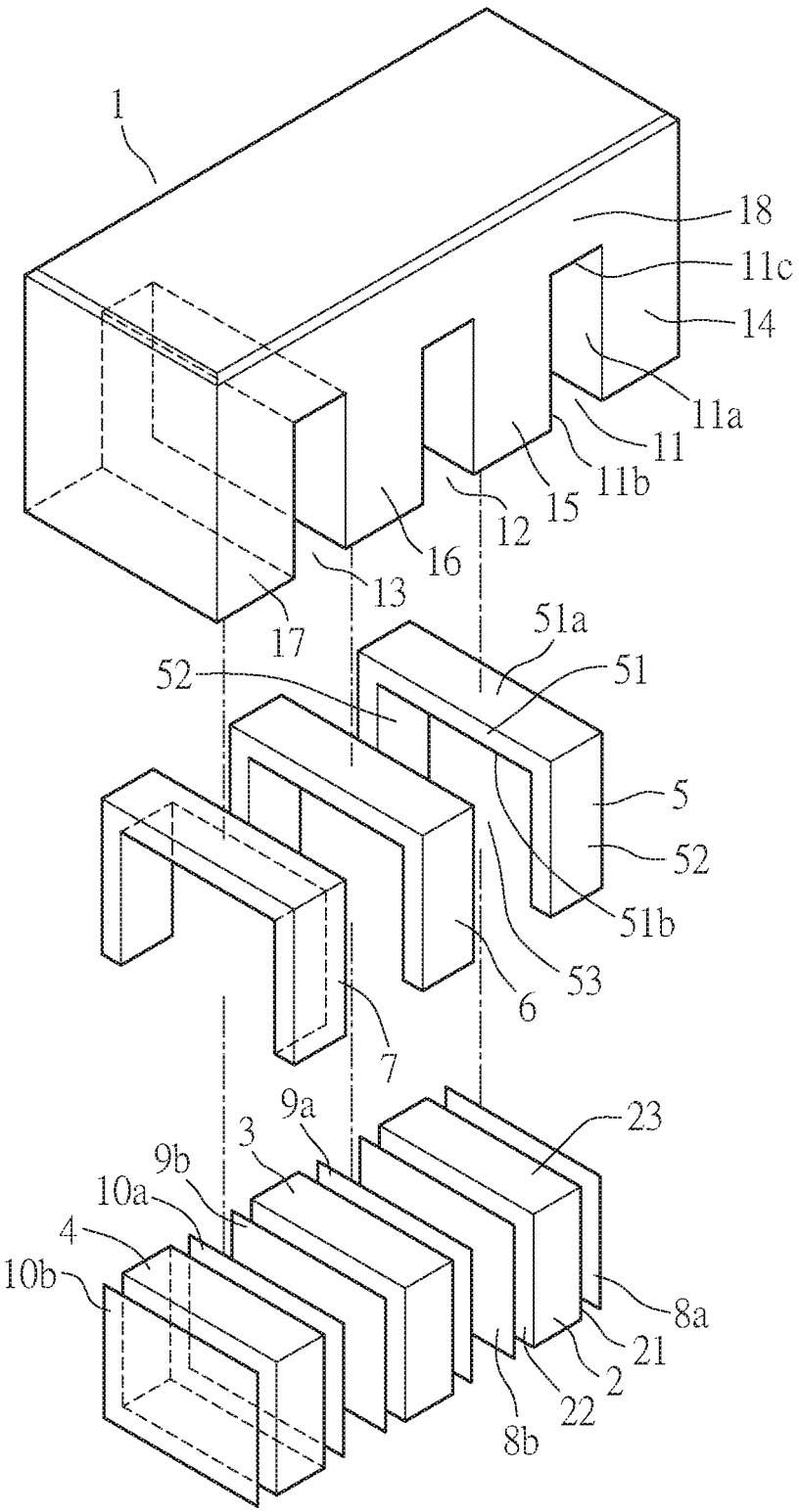
FIG. 1 shows a schematic diagram depicting an exploded perspective view of a three-phase inductor in one embodiment of the disclosure.

Reference is made to FIG. 1 depicting an uncoupled multi-phase inductor. The uncoupled multi-phase inductor includes a primary iron core 1, a plurality of secondary iron cores 2, 3 and 4, a plurality of metal strip coils 5, 6 and 7, and a plurality of sheet members 8*a*, 8*b*, 9*a*, 9*b*, 10*a* and 10*b*. The primary iron core 1 includes a plurality of grooves 11, 12 and 13. The grooves 11, 12 and 13 shown in the figure form a lower portion of the primary iron core 1. A certain number of middle cylinders 14, 15, 16 and 17 are formed in the grooves 11, 12 and 13 correspondingly and also in the midst of the grooves 11, 12 and 13. The plurality of secondary iron cores 2, 3 and 4 are correspondingly disposed in the grooves 11, 12 and 13. The plurality of metal strip coils 5, 6 and 7 are correspondingly disposed in the spaces between the grooves 11, 12 and 13 and their corresponding secondary iron cores 2, 3 and 4. As the reference signs shown in FIG. 1, two sheet members 8*a* and 8*b* of the plurality of sheet members are disposed among a right inner wall 11*a* of a groove of the primary iron core 1, a left inner wall 11*b* of a groove of the primary iron core 1, a right side assembly surface 21 of a secondary iron core 2 and a left side assembly surface 22 of the secondary iron core 2.

In one embodiment, every groove (11, 12 and 13) individually includes a right inner wall 11*a*, a left inner wall 11*b* and an upper inner wall 11*c*. FIG. 1 exemplarily shows the groove 11 and its components that can be made to refer to other grooves, e.g. the grooves 12 and 13, in the present embodiment. Every secondary iron core (2, 3 and 4) has a right side assembly surface 21, a left side assembly surface 22 and an upper side assembly surface 23. Similarly, the description with respect to the secondary iron core 2 and its structural references is also made to refer to other secondary iron cores, e.g. the secondary iron cores 3 and 4.

As shown in the diagram, the grooves 11, 12, 13 of the primary iron core 1, the middle cylinders 14, 15, 16, 17, the plurality of secondary iron cores 2, 3, 4 and the plurality of metal strip coils 5, 6, 7 are assembled so as to form one single device having a plurality of inductor components. The inductor components are exemplarily indicative of a first inductor, a second inductor and a third inductor that administrate the air gaps between the primary iron core 1 and the plurality of secondary iron cores 2, 3 and 4 through an arrangement of the plurality of sheet members 8*a*, 8*b*, 9*a*, 9*b*, 10*a* and 10*b*. This arrangement reaches a required number of the inductors in one single device as shown in FIG. 1. Compared to the conventional design, the exemplary embodiment of the disclosure shows that the plurality of inductor components are not bonded directly but the intervened middle cylinders 15 and 16 are disposed among the inductors. An uncoupled multi-phase inductor is therefore provided.

Figure 2:
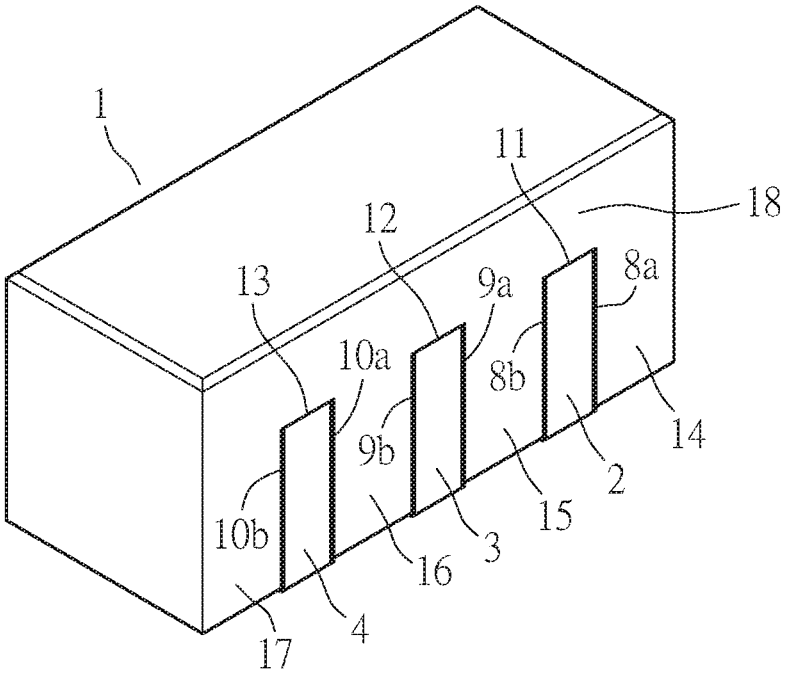
FIG. 2 shows a schematic diagram depicting a perspective view of an assembly of the inductor according to a first embodiment of the disclosure.

FIG. 2 shows a perspective view of an assembly of the components described in FIG. 1 according to one embodiment of disclosure. This first embodiment shows the uncoupled multi-phase inductor having three inductors that are integrated into one device.

In an exemplary example, in addition to the grooves 11, 12, 13 and the plurality of middle cylinders 14, 15, 16, 16 of the primary iron core 1, the primary iron core 1 further includes an upper iron core 18. Relatively, the grooves 11, 12, 13 and the middle cylinders 14, 15, 16, 17 are disposed underneath the primary iron core 1. In one embodiment, the primary iron core 1 can be a serrated iron core. Furthermore, the mentioned secondary iron cores 2, 3 and 4 can be an I-shaped iron core, an I-sheet-shaped iron core, a T-shaped altered by the I-shaped iron core, or a near-I-shaped iron core. The primary iron core 1 and the secondary iron cores 2, 3, 4 can be made of ferrite material, or other soft magnetic material other than the ferrite. Still further, the dispositions of the right side assembly surface 21 and the left side assembly surface 22 of the secondary iron core are corresponding to the right inner wall 11*a* and the left inner wall 11*b* of the groove of the primary iron core 1.

The metal strip coil (5, 6 and 7) can be an n-shaped, a C-shaped, or any geometric-shaped metal strip coil. The metal strip coil (5, 6 and 7) can be made of copper sheet through a stamping manufacturing process. Further, the metal strip coil (5, 6 and 7) may also be made of other kinds of conductive materials. The plurality of metal strip coils 5, 6, 7 can be respectively with one middle beam represented by the beam 51 of the metal strip coil 5. Other metal strip coils 6 and 7 respectively have the beams 61 and 71.

The two ends of the beam 51 extend to outside and bend downwards so as to form two vertical planes respectively. Therefore the two ends of the beam 51 form the conductive leads 52 as shown in FIG. 1. That is the metal strip coil is made by the two vertical planes formed by the two downward bending ends of the beam 51. The vertical planes form the conductive leads 52 that can extend beyond a bottom surface of the primary iron core for standing high the uncoupled multi-phase inductor. This configuration is provided for the multi-phase inductor to be plugged to a circuit board through through-holes for the convenience of welding. The beam 51 has an upper surface 51*a* and a lower surface 51*b*. The beam 51 and the two leads 52 form an assembly space 53 that is provided for assembling the secondary iron core 21.

The sheet members 8*a*, 8*b*, 9*a*, 9*b*, 10*a* and 10*b* can be made of various kinds of non-Ferromagnetic materials. The major objective of the sheet members 8*a*, 8*b*, 9*a*, 9*b*, 10*a* and 10*b* is to embody the right inner wall, the left inner wall and the upper inner wall of the grooves 11, 12 and 13 of the primary iron core 1, and therefore to form several gaps between the secondary iron cores 2, 3, 4 and the assembly surfaces. The gaps act as the air gaps among the first inductor, the second inductor and the third inductor. The plurality of the sheet members 8*a*, 8*b*, 9*a*, 9*b*, 10*a* and 10*b* can be divided into a plurality of right-side sheet members 8*a*, 9*a* and 10*a* and a plurality of left-side sheet members 8*b*, 9*b* and 10*b*. In practice, the sheet members 8*a*, 8*b*, 9*a*, 9*b*, 10*a* and 10*b* are manufactured by non-Ferromagnetic materials including a mylar sheet, a kraft sheet, a plastic sheet, a glass sheet, or an assembly of different non-Ferromagnetic materials. Further, the air gaps between the inductors can also be implemented by other methods. For example, the two iron cores can be spaced at intervals by air. The distance of the gap dominates the inductance value of the device.

The description about how to assembling the uncoupled multi-phase inductor of the disclosure is as follows.

The assembly of the primary iron core 1, the plurality of secondary iron cores 2, 3, 4, the plurality of metal strip coils 5, 6, 7 and the plurality of sheet members 8*a*, 8*b*, 9*a*, 9*b*, 10*a*, 10*b* is disclosed. In a first step, the upper surface 51*a* of the beam of the metal strip coil 5 is assembled with the upper inner wall 11*c* of the groove of the primary iron core 1. Next, the right side assembly surface 21 of the secondary iron core 2 is disposed opposite to the surface of right inner wall 11*a* of the groove 11 of the primary iron core 1. The left side assembly surface 22 of the secondary iron core 2 is disposed opposite to the surface of left inner wall 11*b* of the groove 11 of the primary iron core 1. Then the assembly of the secondary iron core 2 is placed into the groove 11 of the primary iron core 1. The right-side sheet member 8*a* is then disposed in the midst of the right inner wall 11*a* of the groove of the primary iron core 1 and the right side assembly surface 21 of the secondary iron core. A kind of glue or the like can be used to complete the assembly. Similarly, the left-side sheet member 8*b* is disposed in the midst of the left inner wall 11*b* of the groove of the primary iron core 1 and the left side assembly surface 22 of secondary iron core 2. A kind of glue or the like can also be used to combine the components. The metal strip coil 6, 7 and the secondary iron core 3, 4 are assembled within the grooves 12 and 13 of the primary iron core 1. The assembly relating to the sheet members 9*a*, 9*b*, 10*a* and 10*b* is similar with the mentioned way to assemble the metal strip coil 5, the secondary iron core 2 and the groove 11.

The primary iron core 1, the secondary iron cores 2, 3, 4 and the metal strip coils 5, 6, 7 are assembled to be one single device or an element that may render a device with a special magnetic circuit design. The device including the uncoupled multi-phase inductor of the disclosure is schematically shown in FIG. 2.

The primary iron core 1 is such as a serrated iron core. The middle cylinder 15 of the primary iron core 1, the right side groove 11, the right side metal strip coil 5, the right side iron core 2, the sheet members 8*a*, 8*b* and another middle cylinder 14 are assembled to be as a first inductor. Further, the middle cylinder 15 of the primary iron core 1, the left-side groove 12, the left-side metal strip coil 6, the left-side secondary iron core 3, the sheet members 9*a*, 9*b* and another middle cylinder 16 as assembled to be as a second inductor.

The first inductor and the second inductor are integrated into one device. The multi-phase inductor can administrate an air gap between every two iron cores through the left-side and the right-side sheet members 8*a*, 8*b*, 9*a* and 9*b* so as to achieve two inductors having the same inductance value or different inductance values. Accordingly, the multi-phase inductor allows a user to conduct flexible adjustments as required.

In one embodiment, the uncoupled multi-phase inductor includes a first inductor, a second inductor and a third inductor that can be referred to the three-phase inductor schematically shown in FIG. 1. The middle cylinder 15 or the middle cylinder 16 of the primary iron core 1 can be shared in the midst of the first inductor and the second inductor, or of the second inductor and the third inductor. The two inductors can be integrated into one device that effectively reduces the number of elements or components used on a printed circuit board assembly (PCBA). On the other hand, the multiple inductors of the uncoupled multi-phase inductor share the middle cylinder 15 or 16 for maximally saving the volume and space. This arrangement allows the product to have high power density that is beneficial to achieve miniaturization of the product and improve some shortcomings.

Figure 3:
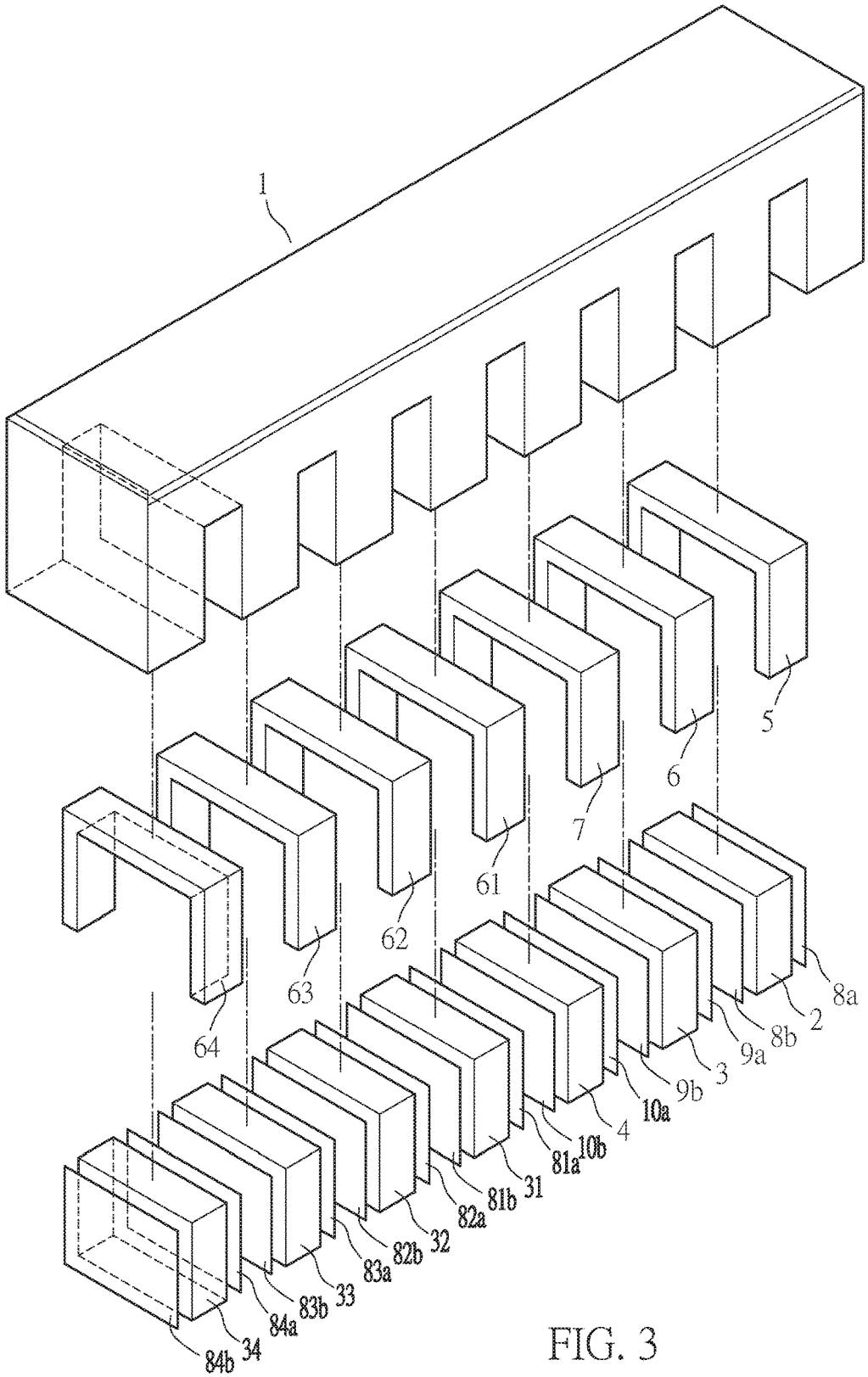
FIG. 3 shows a schematic diagram depicting an exploded perspective view of a seven-phase inductor in another embodiment of the disclosure.

FIG. 3 schematically shows a second embodiment of the uncoupled multi-phase inductor of the disclosure. A seven-phase inductor is described in the diagram. A primary iron core shown in FIG. 3 is conceptually similar with the primary iron core 1 of FIG. 1. It is noted that the significant difference of the primary iron core 1 shown in FIG. 3 from FIG. 1 is the seven grooves that individually correspond to the seven secondary iron cores 2, 3, 4, 31, 32, 33 and 34, and the seven metal strip coils 5, 6, 7, 61, 62, 63 and 64. Similarly, the seven grooves can be disposed as corresponding to the multiple sheet members including a plurality of right-side sheet members 8*a*, 9*a*, 10*a*, 81*a*, 82*a*, 83*a*, 84*a* and a plurality of left-side sheet members 8*b*, 9*b*, 10*b*, 81*b*, 82*b*, 83*b*, 84*b*. The aspect to assemble these elements can be referred to FIG. 1. Thus this single device integrates the seven inductors. The seven inductors also share the plurality of middle cylinders of the primary iron core 1 and the air gaps formed by the right-side sheet members 8*a*, 9*a*, 10*a*, 81*a*, 82*a*, 83*a*, 84*a* and the left-side sheet members 8*b*, 9*b*, 10*b*, 81*b*, 82*b*, 83*b*, 84*b*. The air gaps also administrate the inductance value of the device. The inductance value can be adjusted as required by the user such as the same or different inductance value between the various inductors.

Figure 4:
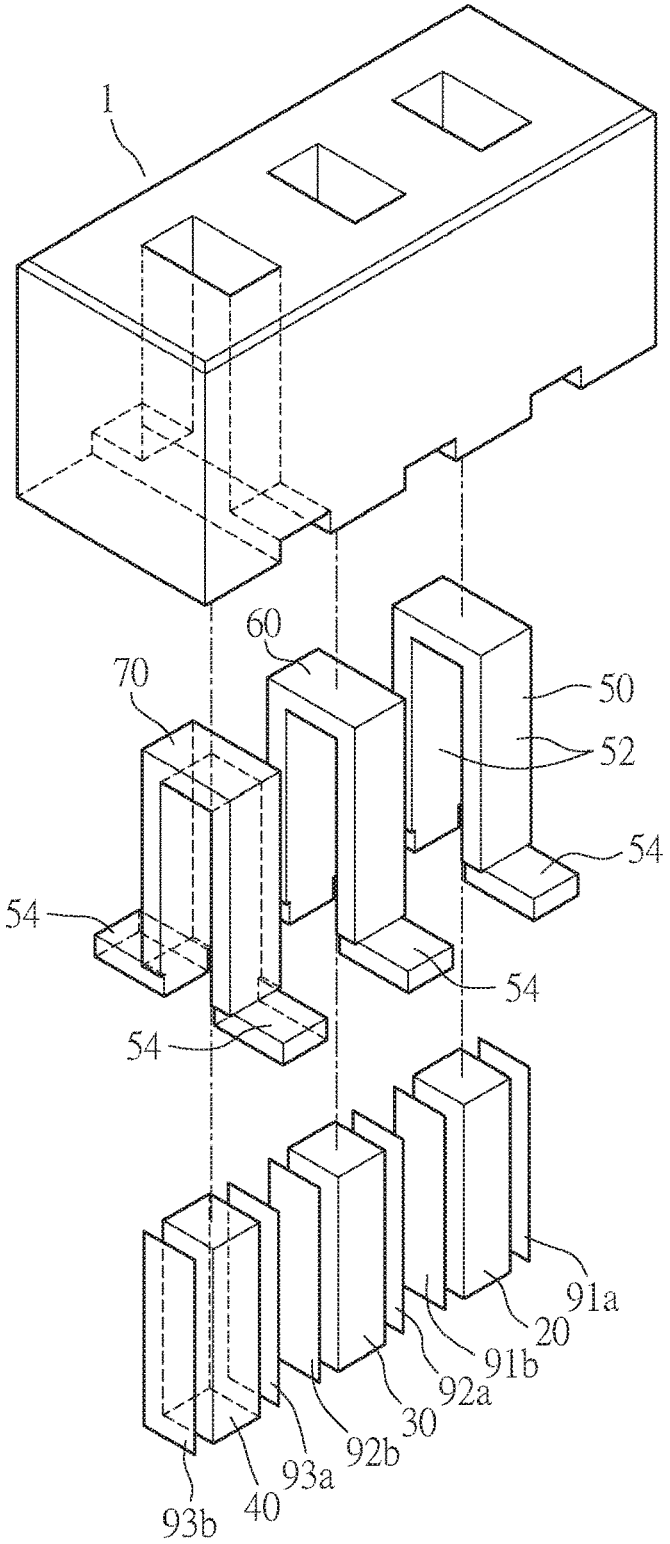
FIG. 4 shows a diagram of an exploded perspective view of the three-phase inductor according to a third embodiment of the disclosure.

FIG. 4 schematically shows a third embodiment of the disclosure. As compared with the first embodiment, both the two vertical planes formed by downward bending the leads 52 of the metal strip coils 50, 60 and 70 of the uncoupled multi-phase inductor of FIG. 4 extend to outside for forming the conductive flat leads 54. It is noted that the metal strip coil 50 or 60 is made by two vertical planes formed by two downward bending ends of the beam. The bottoms of the conductive flat leads 54 can be coplanar with the bottom surface of the primary iron core 1 for allowing the uncoupled multi-phase inductor to be combined over a plate. For example, the coplanar bottoms of the components are easy to be bonded over a circuit board, e.g. a SMD. The C-shaped bending portions of the vertical planes can act as, but not limited to, the leads 52 or the deformed flat leads 54.

The two flat leads 54 can be adapted to the metal strip coils 50, 60 and 70. The shapes of the grooves of the primary iron core 1 can be configured to contain the metal strip coils 50, 60 and 70. For example, the grooves of the primary iron core 1 may be the high-cap-shaped grooves as shown in FIG. 4. Further, the secondary iron cores 20, 30 and 40 are configured to be long I-shaped for fitting the metal strip coils 50, 60 and 70. The right-side sheet members 91*a*, 92*a*, 93*a* and the left-side sheet members 91*b*, 92*b*, 93*b* are also provided to be integrated into the device. One single device including the three inductors is therefore provided. This device can be mounted on a circuit board in a form of a SMD component. The metal strip coils 50, 60 and 70 can also have the leads 52 extending beyond the bottom surface of the primary iron core 1 as shown in the first embodiment. The device of the uncoupled multi-phase inductor can be standing high that allows a user to weld through the through-holes.

Figure 5:
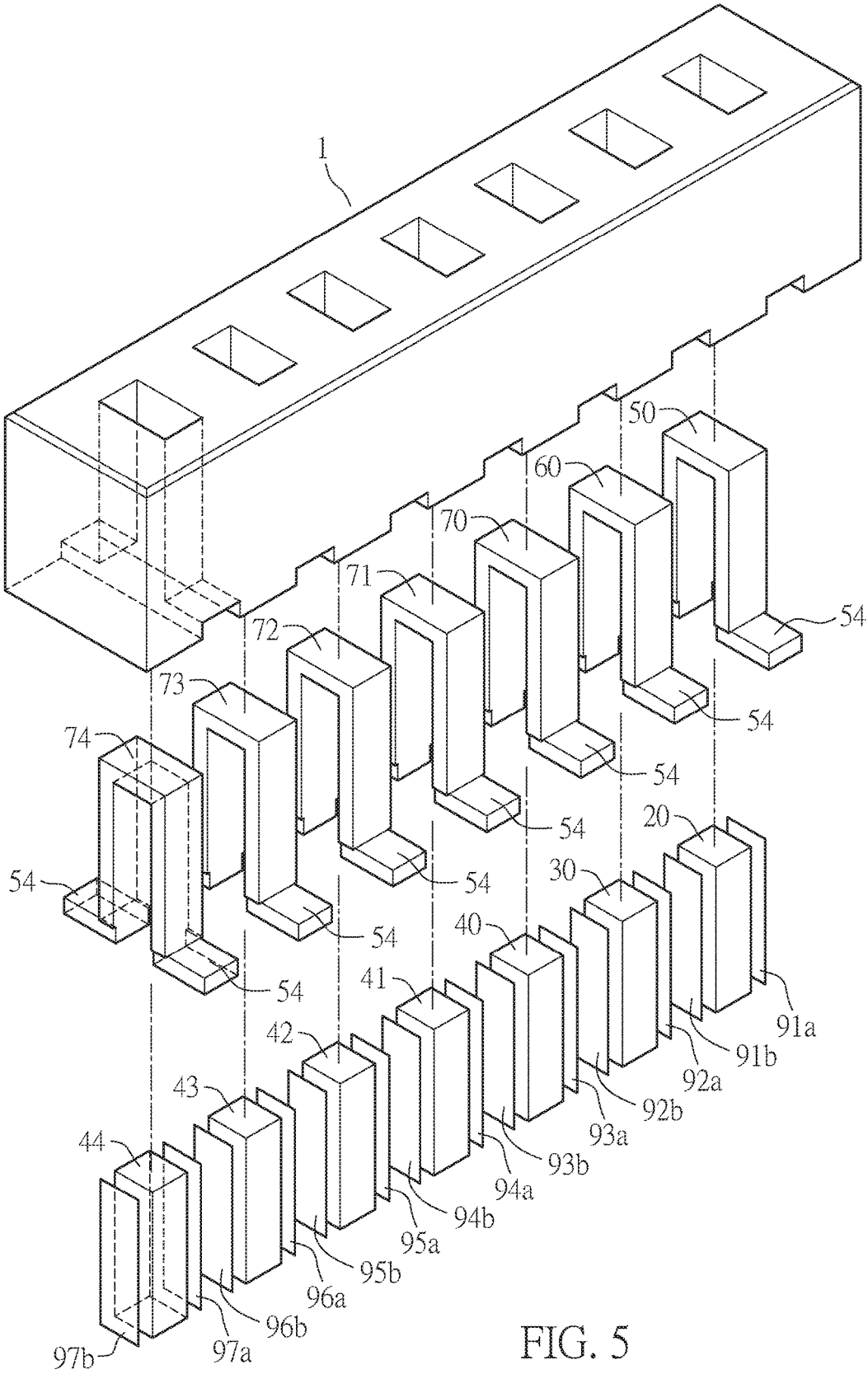
FIG. 5 shows a diagram depicting an exploded perspective view of the seven-phase inductor according to a fourth embodiment of the disclosure.

FIG. 5 shows a fourth embodiment of the disclosure. Compared to the content of the third embodiment described in FIG. 4, the device in accordance with the fourth embodiment includes seven inductors in addition to other similar components. The primary iron core 1 of the fourth embodiment is configured to provide seven grooves that correspond to the seven secondary iron cores 20, 30, 40, 41, 42, 43, 44, the seven metal strip coils 50, 60, 70, 71, 72, 73, 74, and also the plurality of sheet members. The sheet members are such as the right-side sheet members 91*a*, 92*a*, 93*a*, 94*a*, 95*a*, 96*a*, 97*a* and the plurality of left-side sheet members 91*b*, 92*b*, 93*b*, 94*b*, 95*b*, 96*b*, 97*b*. The assembly of these elements is similar with the assembly described in FIG. 4. The mentioned seven inductors are integrated into one device and the elements also share the middle cylinders of the primary iron core 1. The device achieves a required inductance value by administrating the air gaps among the right-side sheet members 91*a*, 92*a*, 93*a*, 94*a*, 95*a*, 96*a*, 97*a* and the left-side sheet member 91*b*, 92*b*, 93*b*, 94*b*, 95*b*, 96*b*, 97*b*. The inductance value can be adjusted as required by the user such as the same or different inductance value between the various inductors.

Figure 6:
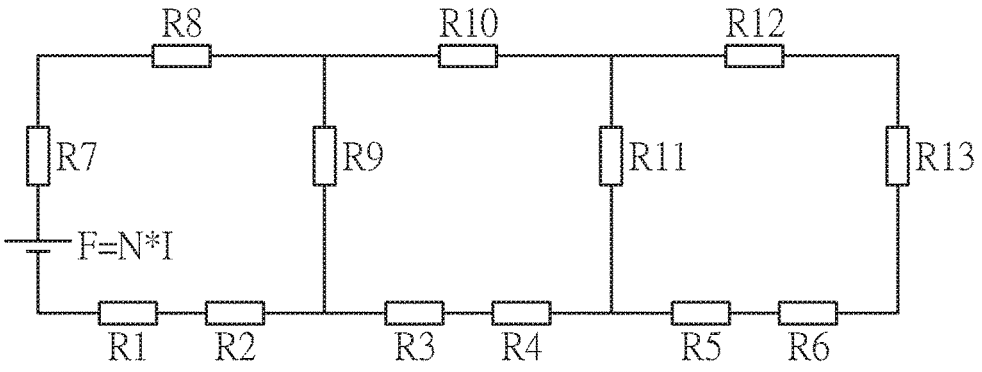
FIG. 6 shows a schematic diagram depicting an equivalent magnetic circuit of the inductor according to the first embodiment of the disclosure.
Figure 7:
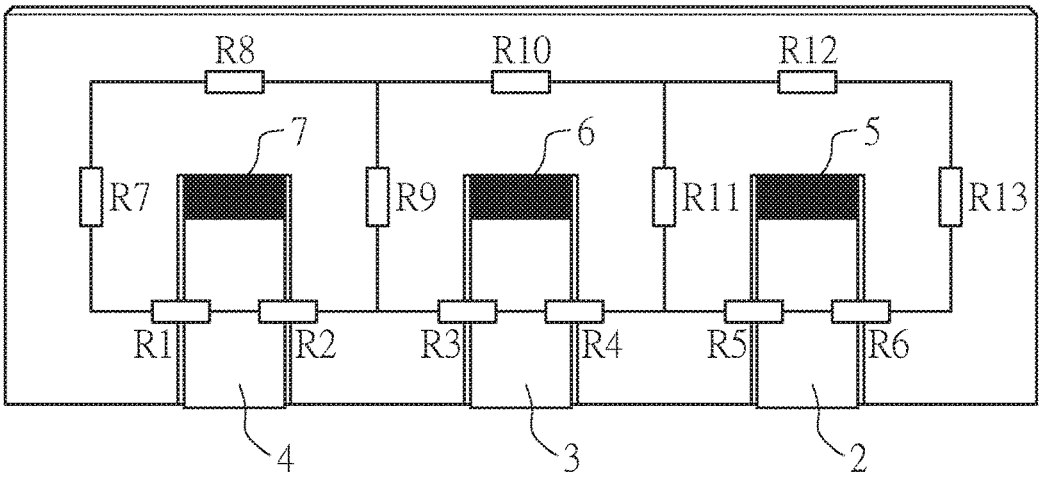
FIG. 7 shows a schematic diagram depicting a circuitry of the equivalent magnetic circuit and inductors according to one of the embodiments of the disclosure.

FIG. 6 and FIG. 7 show the magnetic circuit design of the uncoupled multi-phase inductor. As shown in the first embodiment of the disclosure, a particular magnetic circuit design can achieve the uncoupled effect of the multi-phase inductor. The following description is based on the magnetic circuit design of FIG. 6 and the actual components with respect to the magnetic circuit design shown in FIG. 7.

The magnetic flux is theoretically similar with the diagram shown in FIG. 6 as the metal strip coil 7 is in operation. It is assumed that a total magnetomotive force of the magnetic circuit is F=N*I (F: magnetomotive force; N: number of turns; I: excitation current), and its equivalent magnetic circuit design is as shown in FIG. 6. Because a magnetic permeability of a magnetic core of the iron core is much greater than the magnetic permeability of air, the magnetic permeability of the magnetoresistances R1, R2, R3, R4, R5 and R6 with the air gaps is much greater than the magnetic permeability of the other magnetoresistances R7, R8, R9, R10, R11, R12 and R13. However, the magnetic flux, which likely acts as the electric current, always flows over the magnetic circuit with low magnetoresistance, and rather the magnetic flux flowing over the magnetic circuit with high magnetoresistance is relatively low. Through the above analysis, it is easy to understand that the arrangement of the magnetoresistances R3, R4, R10 and R11" being connected in series and connected with the magnetoresistance R9 in parallel means it is connected with the equivalent magnetic circuit driven by the magnetomotive force F=N*I in parallel. Further, a magnetic flux of a bypass circuit of the magnetoresistances R3, R4, R10 and R11" is almost zero since the magnetic resistance of the magnetoresistances R3, R4, R10 and R11" are the much greater than the magnetoresistance R9. Therefore, when the metal strip coil 7 has a magnetomotive force F=N*I for exciting a magnetic potential, the metal strip coils 5 and 6 have very low degree of coupling. Similarly, it also reaches a very low degree of coupling among the multiple inductors of other metal strip coils. It should be noted that the magnetoresistance R11" is an equivalent magnetoresistance due to the magnetoresistances R5, R6, R13, R12 are connected in series and connected with the magnetoresistance R11 in parallel.

It is also emphasized that, according to the disclosed uncoupled multi-phase inductor, the inductance values of the multiple inductors are obtained by administrating the air gaps among the inductors through the thicknesses of different right-side sheet members. The mentioned inductance values of the multiple inductors can be the same or different due to they are administrated by the various thicknesses of the right-side sheet members. It is also noted that the structure, size and material of the metal strip coils 5, 6 and 7 define the direct current resistances regarding to the different inductors. Further, the direct current resistances of the adjacent two inductors can be the same or different.

Still further, the device with the uncoupled inductors can extend beyond the bottom surface of the primary iron core 1 through the conductive leads 52 for standing high the uncoupled multi-phase inductor, and thus the other elements can still be disposed over the bottom surface for saving usage of the space of a printed circuit board and increasing its power density.

In sum, the disclosed uncoupled multi-phase inductor, referring to the above qualitative analysis, can obviously improve the performance with respect to the conventional single inductor and multi-phase inductor. The disclosed uncoupled multi-phase inductor also enriches characteristic expression of the inductor device since the inductor effectively saves the volume and space and provides some specific solutions for special requirement. Therefore, the disclosed uncoupled multi-phase inductor meets judicial requirements of novelty, inventive step and also industrial use.

It is intended that the specification and depicted embodiment be considered exemplary only, with a true scope of the invention being determined by the broad meaning of the following claims.

What is claimed is:

1. An uncoupled multi-phase inductor, comprising:

a primary iron core disposed with multiple grooves, and a plurality of middle cylinders formed among the grooves correspondingly;

a plurality of secondary iron cores correspondingly disposed within the multiple grooves;

a plurality of metal strip coils correspondingly disposed among the grooves and the plurality of secondary iron cores; and a plurality of sheet members correspondingly disposed among right inner walls of the grooves, left inner walls of the grooves and the plurality of secondary iron cores;

wherein, the plurality of middle cylinders of the primary iron core, the secondary iron cores within the grooves, and the metal strip coils are assembled, and the plurality of sheet members are also integrated for forming one single device with multiple inductors; and the multiple inductors administrate air gaps between the primary iron core and the secondary iron cores by the plurality of sheet members for reaching a requisite inductance.

2. The inductor according to claim 1, wherein each of the plurality of secondary iron cores is an I-shaped iron core, an I-sheet-shaped iron core, a T-shaped altered by the I-shaped iron core, or a near-I-shaped iron core.

3. The inductor according to claim 1, wherein, in the plurality of grooves, every groove has a right inner wall, a left inner wall and an upper inner wall; in the plurality of secondary iron cores, every secondary iron core has a right side assembly surface, a left side assembly surface and an upper side assembly surface; wherein the right side assembly surface of the secondary iron core is bonded with the right inner wall of the groove, and the left side assembly surface of the secondary iron core is bonded with the left inner wall of the groove.

4. The inductor according to claim 3, wherein the plurality of sheet members include a plurality of right-side sheet members and left-side sheet members; every right-side sheet member is disposed between the right side assembly surface of the secondary iron core and the right inner wall of the groove, and every left-side sheet member is disposed between the left side assembly surface of the secondary iron core and the left inner wall of the groove.

5. The inductor according claim 1, wherein, every metal strip coil includes a beam, and an upper surface of the beam and the upper inner wall of the groove are bonded; a lower surface of the beam and the upper side assembly surface of the secondary iron core are bonded.

6. The inductor according to claim 1, wherein the primary iron core and the plurality of secondary iron cores are ferrite materials or soft magnetic materials; the plurality of metal strip coils are manufactured by a stamping process using a copper sheet or a conductive material.

7. The inductor according to claim 1, wherein the sheet members are manufactured by non-Ferromagnetic materials including a mylar sheet, a kraft sheet, a plastic sheet, a glass sheet, or an assembly of different non-Ferromagnetic materials.

8. The inductor according to claim 1, wherein the metal strip coil is made by two vertical planes formed by two downward bending ends of the beam, and the two vertical planes form conductive leads; the conductive leads extend beyond a bottom surface of the primary iron core for standing high the uncoupled multi-phase inductor; wherein the two vertical planes further extend downward for a through-hole welding installation.

9. The inductor according to claim 1, wherein the metal strip coil is made by two vertical planes formed by two downward bending ends of the beam, and the two vertical planes stretch outward for forming conductive flat leads respectively; the bottoms of the conductive flat leads are coplanar with the bottom surface of the primary iron core for allowing the uncoupled multi-phase inductor to be combined over a plate.

10. The inductor according to claim 1, wherein, in the uncoupled multi-phase inductor, the multi-phase inductor is a two-phase inductor, a three-phase inductor, a five-phase inductor, a seven-phase inductor or a nine-phase inductor, and every inductor is an inductor component of a device.

* * * * *